US008540565B2

(12) United States Patent
Burghard et al.

(10) Patent No.: US 8,540,565 B2
(45) Date of Patent: Sep. 24, 2013

(54) GAMING MACHINE INCLUDING MOVING WILD SYMBOLS

(75) Inventors: Berndt Burghard, Guntramsdorf (AT); Jan Degenhart, Vienna (AT)

(73) Assignee: Novomatic AG, Gumpoldskirchen (AT)

( * ) Notice: Subject to any disclaimer, the term of this patent is extended or adjusted under 35 U.S.C. 154(b) by 0 days.

(21) Appl. No.: 13/356,558

(22) Filed: Jan. 23, 2012

(65) Prior Publication Data

US 2013/0190068 A1 Jul. 25, 2013

(51) Int. Cl.
*A63F 9/00* (2006.01)

(52) U.S. Cl.
USPC ..... 463/20

(58) Field of Classification Search
None
See application file for complete search history.

(56) References Cited

U.S. PATENT DOCUMENTS

| | | | | |
|---|---|---|---|---|
| 7,195,559 | B2 * | 3/2007 | Gilmore et al. | 463/20 |
| 7,758,415 | B2 * | 7/2010 | Kojima | 463/20 |
| 8,007,357 | B2 * | 8/2011 | Cuddy et al. | 463/20 |
| 8,137,179 | B2 * | 3/2012 | Jensen et al. | 463/20 |
| 8,177,622 | B2 * | 5/2012 | Englman | 463/20 |
| 8,241,107 | B2 * | 8/2012 | Moroney | 463/20 |
| 8,257,161 | B2 * | 9/2012 | Louie et al. | 463/20 |
| 8,303,393 | B2 * | 11/2012 | Jaffe et al. | 463/16 |
| 2002/0119814 | A1 * | 8/2002 | Fong et al. | 463/13 |
| 2004/0033827 | A1 * | 2/2004 | Gilmore et al. | 463/20 |
| 2004/0048646 | A1 * | 3/2004 | Visocnik | 463/16 |
| 2005/0054423 | A1 * | 3/2005 | Wadleigh | 463/20 |
| 2007/0287523 | A1 * | 12/2007 | Esses et al. | 463/20 |
| 2008/0032784 | A1 * | 2/2008 | Englman | 463/21 |
| 2008/0108411 | A1 * | 5/2008 | Jensen et al. | 463/20 |
| 2008/0113742 | A1 * | 5/2008 | Amos et al. | 463/20 |
| 2008/0287178 | A1 * | 11/2008 | Berman et al. | 463/20 |
| 2009/0075721 | A1 * | 3/2009 | Pacey et al. | 463/20 |
| 2009/0075722 | A1 * | 3/2009 | Louie et al. | 463/20 |
| 2009/0104967 | A1 * | 4/2009 | Thomas et al. | 463/20 |
| 2009/0227356 | A1 * | 9/2009 | Moroney | 463/20 |
| 2010/0190542 | A1 * | 7/2010 | Mizue | 463/20 |
| 2010/0197377 | A1 * | 8/2010 | Aoki et al. | 463/20 |
| 2010/0210344 | A1 * | 8/2010 | Edidin et al. | 463/20 |
| 2010/0248811 | A1 * | 9/2010 | Jaffe et al. | 463/20 |
| 2010/0267445 | A1 * | 10/2010 | Gomez | 463/25 |
| 2010/0304836 | A1 * | 12/2010 | Yoshizawa et al. | 463/20 |
| 2011/0105215 | A1 * | 5/2011 | Mizue | 463/20 |

* cited by examiner

*Primary Examiner* — Seng H Lim
(74) *Attorney, Agent, or Firm* — Kevin H. Fortin

(57) ABSTRACT

A gaming machine having standard and bonus game play features. During standard game play mode, the interface displays a matrix of symbols representing an arrangement of reels, and the computer calculates payouts based on the symbols, within the matrix. When a predetermined number of scatter symbols appear in the matrix of symbols in standard game play mode, bonus game play commences and at least some of the scatter symbols are transformed into wild symbols during bonus game play. Bonus game play mode includes multiple reel spins. The wild symbols presented during bonus game play mode occupy more than one location in the matrix of symbols and move during each reel spin to a random location in the matrix of symbols. The random location in the matrix of symbols excludes matrix locations previously occupied by a wild symbol during an immediately previous reel spin during bonus game play.

7 Claims, 5 Drawing Sheets

GAMING MACHINE INCLUDING MOVING WILD SYMBOLS

FIELD OF THE INVENTION

The invention pertains to gaming machines including slot machines, and particularly to slot machines having wild symbols and bonus game features.

BACKGROUND OF THE INVENTION

In the gaming machine industry, there is a continuing need for gaming machine manufacturers to produce new types of games, or enhancements to existing games, which will attract frequent play by enhancing the entertainment value and excitement associated with the game. Presently there is a trend with slot machines to offer additional games that can be played, in addition to standard game play involving spinning reels. These additional games are often referred to as a "feature game", or "bonus game".

US 2010/0304831 A1, to Suda et al. shows a slot machine having an array of symbols displayed for both primary and secondary (e.g. bonus) game play. The feature game play is entered upon the occurrence of a selected event or outcome of the basic game. In particular, Suda describes using a subset of columns to indicate whether feature game capability is achieved. In one embodiment, the columns in which scatter symbols appear are selected for feature game purposes. A "scatter symbol" is a symbol that indicates some kind of special bonus, or bonus play.

US 2009/0275387 A1, to Yoshizawa, discloses a slot machine that displays a matrix of symbols as part of the primary game play and secondary game play occurs where the symbols are classified according to background color. The symbols having a common background color are grouped and re-positioned adjacent to each other on the display. In other words, symbols positioned once on a display are repositioned so as to gather the symbols with the same background color. Yoshizawa confirms that background effects can be an important part of gaming experience, particularly with secondary or feature game play.

US 2008/0108411 A1, to Jensen et al. discloses a slot machine gaming device having a roaming wild symbol where when a wild symbol appears on one of the reels and a designated trigger symbol also appears, the wild symbol expands to form an expanded wild symbol set. The trigger symbol determines the number of times the expanded wild symbol set will roll or move across the reels. This provides a variant of standard slot machine play that interests game players.

The gaming industry is competitive and ever-evolving. Although many games continue to entertain gaming enthusiasts, there is still an unmet need for better and more interesting games and features. There is also an unmet need for making gaming experience user-friendly to enable a player to readily understand the various gaming features and variations available, particularly with respect to feature games that follow different rules than standard slot machine reel play.

SUMMARY OF THE INVENTION

A gaming machine includes a housing having a user interface, a lower display and an upper display, and a computer having a controller mounted in the housing and in communication with the lower display and the upper display. The controller enables standard game play mode, having standard game play features until the occurrence of a predetermined event to enable bonus game play features.

The computer is in operative communication with the interface, the computer having a memory and a processor, the memory stores game play instructions and a set of symbols including game symbols, scatter symbols and wild symbols.

The game play instructions include instructions for standard game play mode and bonus game play mode. During standard game play mode, the interface displays a matrix of symbols representing an arrangement of reels, and the computer calculates payouts based on the symbols, which are randomly arranged within the matrix. When a predetermined number of scatter symbols appear in the matrix of symbols in standard game play mode, bonus game play commences and at least some of the scatter symbols are transformed into wild symbols during bonus game play.

Bonus game play mode includes multiple reel spins. The wild symbols presented at commencement of bonus game play mode move during each reel spin to a random location in the matrix of symbols. The random location in the matrix of symbols and be purely random or pseudo random. The random location in the matrix of symbols excludes any matrix locations previously occupied by a wild symbol during an immediately previous reel spin during bonus game play.

Preferably the random location in the matrix of symbols having at least one of the wild symbols includes more than one position in the matrix of symbols. This enables the wild symbol to appear in two locations simultaneously. According to game play rules, the maximum number of wild symbols displayed in any matrix column is one and the wild symbol occupies two locations in any matrix column where the wild symbol appears. Bonus game play lasts for ten reel spins, and bonus game play commences when four scatter symbols appear.

Preferably, the matrix of symbols is a four by five matrix having twenty symbols.

During bonus game play, the computer determines mode paylines and payouts after each reel spin, upon completion of bonus game play mode, the computer credits the sum of any payouts to the standard game play.

Although enabling wild symbols to occupy two adjacent matrix locations in a single column, it is practical where the wild symbols appear on the edge of the matrix, i.e. in the first or last row, that the wild symbol may occupy a single matrix location.

DETAILED DESCRIPTION

Figure 1:
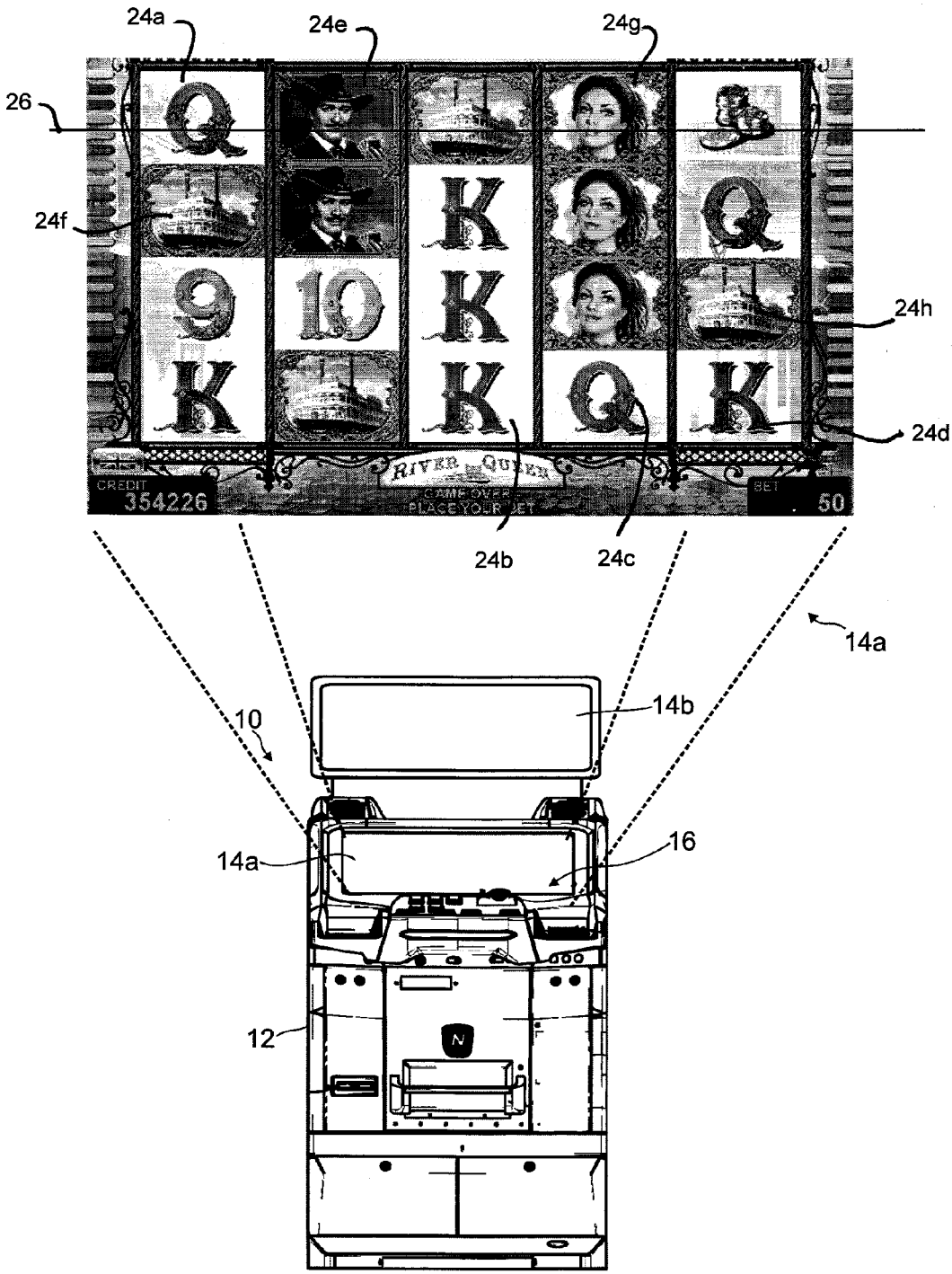
FIG. 1 is a front view of a housing displaying a slot machine reel.

FIG. 1 shows a gaming machine 10. The gaming machine 10 is a slot-machine capable of various game play modes.

Initially the gaming machine 10 operates in standard game play mode until the occurrence of a random event, and then the gaming machine 10 operates in a bonus game play mode. In standard game play mode a matrix of symbols are displayed in a format including five reels oriented in columns and three horizontal rows. The reels in one embodiment are physical reels that spin, and in another embodiment, the reels are images of physical reels.

The gaming machine 10 is preferably a slot machine. The gaming machine 10 includes a housing 12 with a lower display 14*a*, an upper display 14*b* and a user interface 16. Slot machine is broadly construed as any gaming machine that is capable of enabling a player to play for entertainment with a probability of a payout.

The interface 16 is supported by the housing 12. The interface 16 faces a user, who may be standing or sitting in proximity to the machine 10. The interface 16 enables user input to initiate and continue game play. In particular, any of a number of buttons can be presented on the interface to enable a user to commence standard game play mode, bonus game play mode, and to select particular bets.

The display 14*a* is configured to display a matrix of symbols 26 that imitate mechanical slot machine reels in standard game play mode according to one aspect of the invention. Accordingly, each column of the matrix of symbols imitates a single mechanical slot machine reel. The display 14*a* is angled with respect to the floor to face a user.

In another embodiment of the invention, the display 14*a* includes mechanical slot machine reels. It can be appreciated that hybrid arrangements having both digital and mechanical components are contemplated herein. The display 14*b* is transmissive to facilitate highlighting of any of the various symbols, and paylines to facilitate game play. Where mechanical slot machine reels are used, the interface also provides images that overlay the mechanical reels.

The matrix of symbols 26 has three rows and five columns. The matrix of symbols 26, however, may include any number of rows and columns in accordance with various game formats. As shown, the matrix of symbols 26 includes a plurality of symbols 24*a*, 24*b*, 24*c* and 24*d*, and scatter symbols 24*e*, 24*f*, 24*g* and 24*h*.

Scatter symbols 24*e*, 24*f*, 24*g* and 24*h* are special symbols because they have the potential to directly or indirectly lead to larger payouts. The icon on the scatter symbol 24*e*, 24*f*, 24*g* and 24*h* is usually closely associated to an important aspect of the theme of the online slot because of its importance. Scatter symbols 24*e*, 24*f*, 24*g* and 24*h* can contrast with other symbols 24*a*, 24*b*, 24*c* and 24*d* so they are easily seen among a matrix of symbols. The scatter symbols 24*e*, 24*f*, 24*g* and 24*h* can be brighter or more animated than the other symbols, for example. Scatter symbols 24*e*, 24*f*, 24*g* and 24*h* differ from wild symbols in that they simply lead to improved payouts and bonuses, rather than replace other symbols as a wild card functions in card game play, for example.

In one aspect of the invention, the gaming machine 10 presents a poker-style game. The matrix of symbols 26 includes playing card values, such as King, Jack, Queen, and various numerical card values. The matrix of symbols 26 may also include any other symbols that create interest to a player including the scatter symbols 24*e*, 24*f* and 24*g*. Although a poker-based theme is described herein, it can be appreciated that the present invention also encompasses non-poker based themes.

The symbols 24 can include still images, or video-streamed images, or a combination of thereof. Such still images, or video streamed images, or any combination thereof, may be displayed using physical reels or virtual reels. Video streamed images enable the symbols 24 to yield an evolving appearance. In particular the size, character and transparency of the symbols may change during game play, particularly upon the appearance of a scatter symbol. When physical reels are used, the images may be highlighted or changed, for example, by using a projection using transmissive technology on the display 14*a*.

The display 14*a* shows any number of paylines crossing horizontal and vertical rows and columns, respectively. In particular, payline 26 is shown extending horizontally across a first row of the matrix of symbols. Any of a variety of paylines can be defined on the display 14*a*, including vertical, diagonal and irregular pay lines.

The payline 26 crosses the top row of the matrix of symbols and is projected on the display 14*a* and indicates a payout. According to game play rules, where at least three scatter symbols appears in standard game play mode, a bonus game play mode is initiated. Bonus game play mode is initiated in alternate embodiments of the invention when four or five scatter symbols appear, respectively.

Here scatter symbols 24*e*, 24*f*, 24*g* and 24*h* appear and enable feature game play so that the payout according to the payline 26. Preferably, bonus game play mode is automatically initiated and accepted by enabling a user to activate a button on the interface 16. The matrix of symbols disappears and is completely replaced by bonus game play images when the gaming machine 10 enters bonus game play mode. It can be appreciated, however, that variants of the invention can retain a portion of the information and symbolism presented from standard game play mode in the feature game play mode, such as a bet amount.

Figure 2:
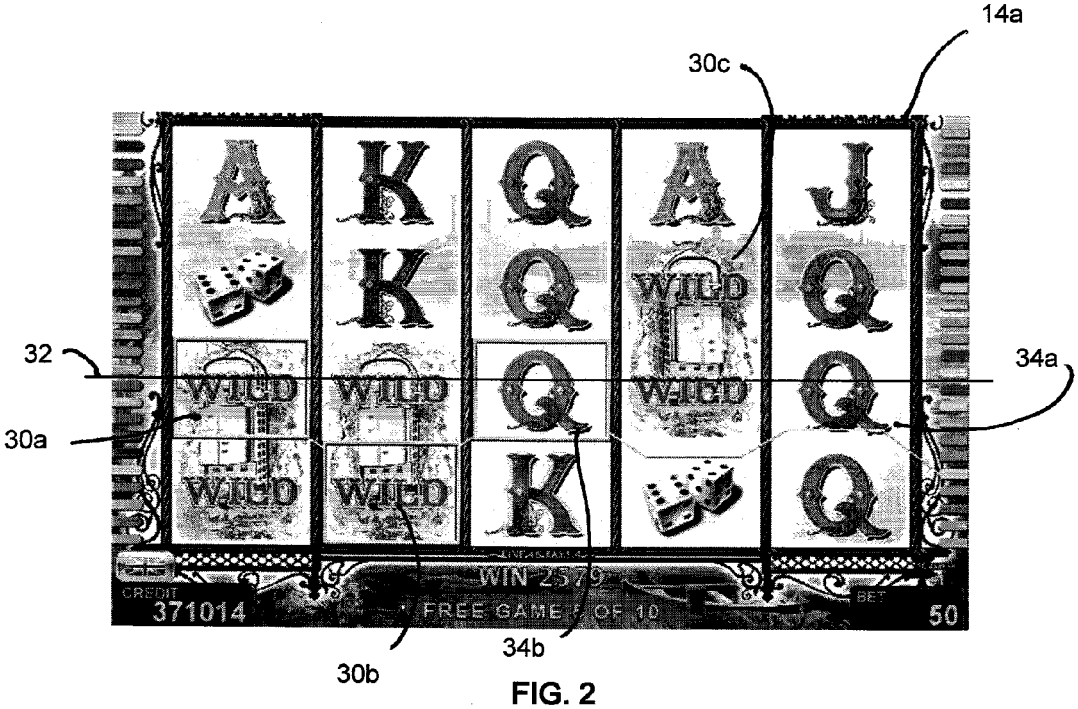
FIG. 2 is a screenshot of the lower display in accordance with the present invention depicting game play.

FIG. 2 shows the display 14*a* in bonus game play mode. At least some of the scatter symbols shown in FIG. 1 are transformed into wild symbols 30*a*, 30*b* and 30*c*. Each wild symbol 30*a*, 30*b* and 30*c* occupies more than one position in the matrix of symbols.

No more than one wild symbol 30*a*, 30*b* or 30*c* is presented in any single column. However, as shown, each wild symbol 30*a*, 30*b* and 30*c* occupies more than one position, preferably two positions, in the matrix of symbols in a single column. Wild symbols 30*a*, 30*b* and 30*c* are able to, and do, occupy multiple positions in a single row. The payline 32 shows three wild symbols and two "Q" symbols 34*a* and 34*b*. Accordingly, a payout commensurate with five horizontal "Q" symbols is indicated by the payline 32.

FIG. 2 shows the display 14*a* in bonus game play mode. The wild symbols 30*a*, 30*b* and 30*c* are animated and flash an image of a slot machine, for example. The wild symbols 30*a*, 30*b* and 30*c* each occupy more than one position in the matrix of symbols. As shown, the wild symbols 30*a*, 30*b* and 30*c* each occupy two positions on a first, second and third column, respectively. The wild symbols 30*a*, 30*b* and 30*c* at least partially cover underlying symbols, which are not wild symbols.

The position of the wild symbols in successive reel spins is determined randomly. In particular, random numbers defining the reel stops of the 5 reels are the random numbers 1-5. The random numbers define vertical positions of each wild symbol on any particular reel (i.e. matrix column).

Each wild symbol can take any of five random vertical positions in response to the random numbers 1-5, which are generated by the computer. Symbol position 1 is the uppermost position on a reel defined as row 1. Symbol position 2 is below symbol position 1, on row two of the reel. Symbol position 3 is below symbol position 2. Symbol position 4 is the lowermost position on the reel.

Wild position 1 covers symbol position 1 (upper half of Wild symbol is outside the visible reel area). Wild position 2 covers symbol position 1 and 2. Wild position 3 covers symbol position 2 and 3. Wild position 4 covers symbol position 3 and 4. Wild position 5 covers symbol position 4 (lower half of Wild symbol is outside the visible reel area). With this assignment it is ensured that all Symbol positions of a reel are "Wild", marked with a wild symbol, with the same probability. When the reels spin, the wild symbols float in a continuously visible manner to one of the randomly generated wild positions.

Figure 3:
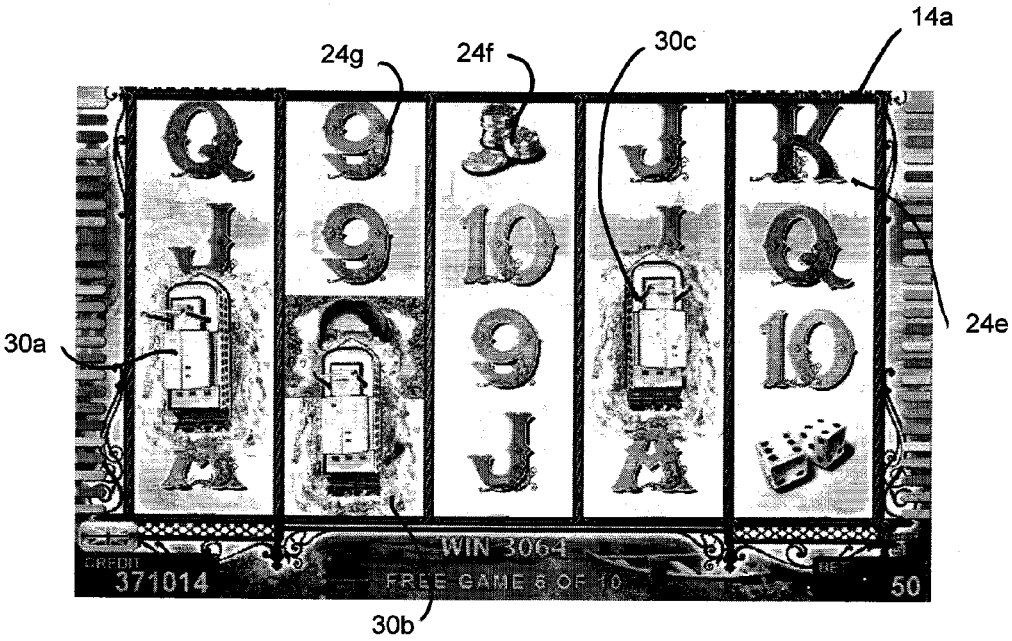
FIG. 3 is a screenshot of the lower display in accordance with the present invention depicting game play.

FIG. 3 shows a reel spin of the display 14*a* commenced after the reel spin shown in FIG. 2. The wild symbols 30*a*, 30*b*, and 30*c* remain stationary occupying the same positions as in the immediately prior spin shown in FIG. 2. The wild symbols 30*a*, 30*b* and 30*c* do not disappear during reel spin, but remain visible before, during and after any bonus mode reel spin. Other symbols 24*e*, 24*f* and 24*g* of the matrix of symbols randomly change during reel spin. Randomness of the other symbols is achieved by traditional reel spinning where mechanical reels are used, or a by applying a randomness algorithm where digital representations of traditional reels are used. The definition of random and randomness as used herein does not require absolute mathematical randomness, but a sufficient degree of randomness to facilitate game play.

Figure 4:
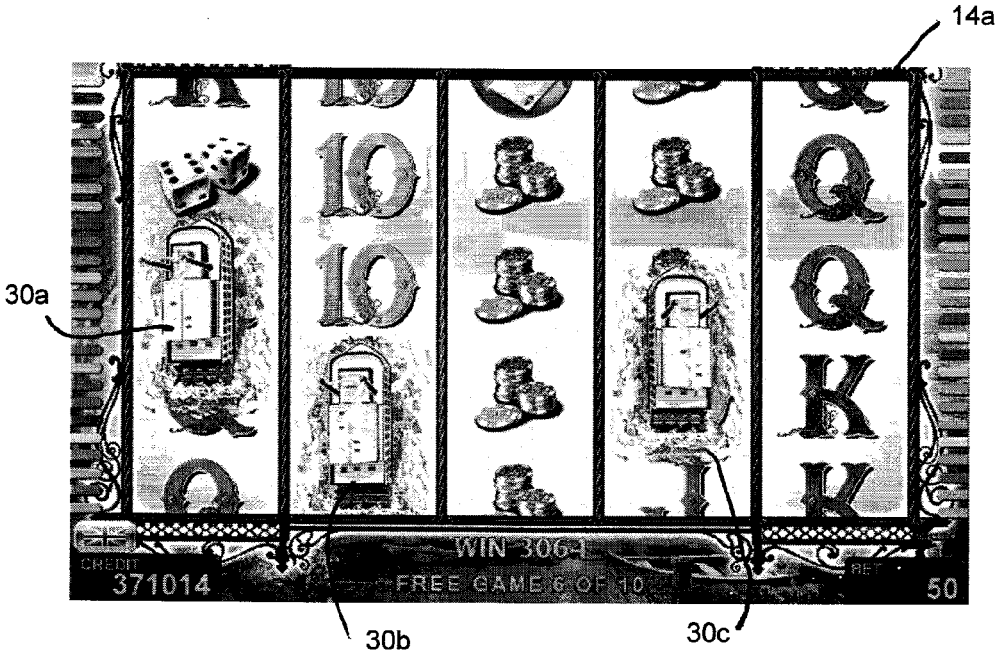
FIG. 4 is a screenshot of the lower display in accordance with the present invention depicting game play.

FIG. 4 shows an additional reel spin of the display 14*a* commenced after the reel spin shown in FIG. 3. The wild symbols 30*a*, 30*b*, and 30*c* appear to remain stationary while the reels spin, and continue to occupy the same positions as in the immediately prior spin shown in FIG. 3.

Figure 5:
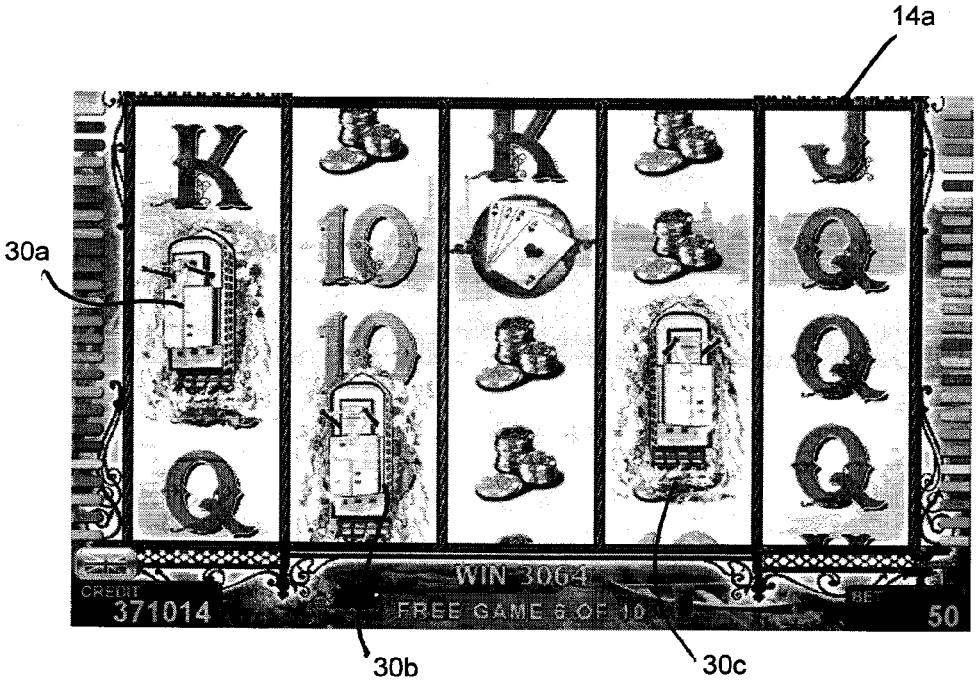
FIG. 5 is a screenshot of the lower display in accordance with the present invention depicting game play.

FIG. 5 shows the reel spin of FIG. 4 continuing. The wild symbols 30*a*, 30*b*, and 30*c* remain relatively stationary, moving only slightly, while the other symbols spin. The wild symbol 30*a* occupies a second and third row of the first matrix column. The wild symbol 30*b* occupies the last row (lower row) of the second matrix column, but only occupies one matrix position because lower row positions are beyond the scope of the matrix of symbols and are not viewable. The wild symbol 30*c* occupies two positions on the $4^{th}$ and $5^{th}$ row of the matrix.

Figure 6:
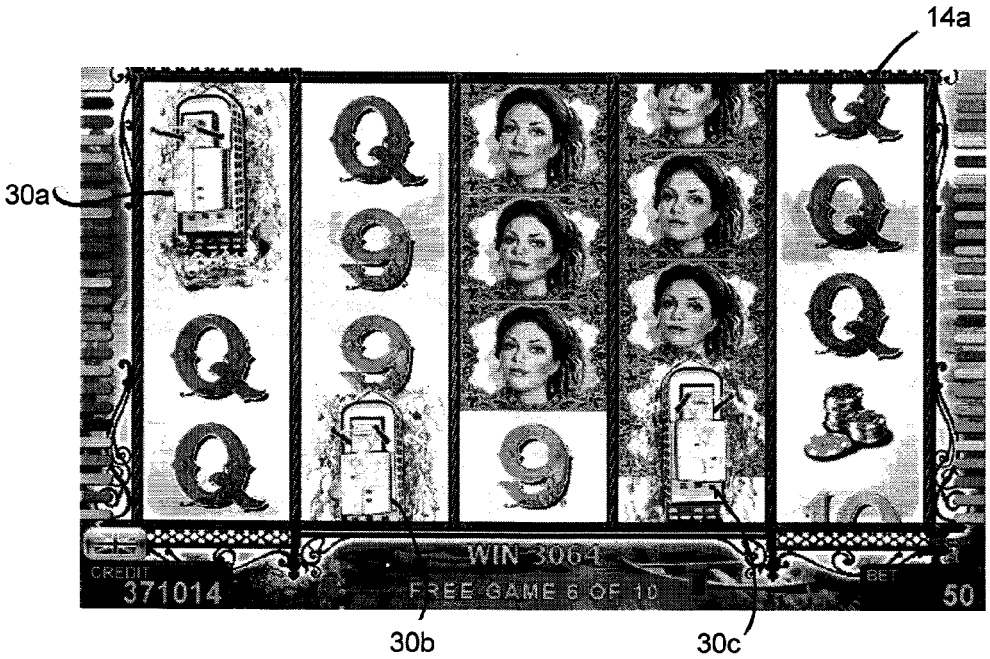
FIG. 6 is a screenshot of the lower display in accordance with the present invention depicting game play.

FIG. 6 shows further movement of the reel spin of FIG. 5. The wild symbols 30*a*, 30*b* and 30*c* remain stationary while the underlying symbols spin, and the wild symbols 30*a*, 30*b* and 30*c* shift randomly to another position as the underlying symbols slow and stop.

Figure 7:
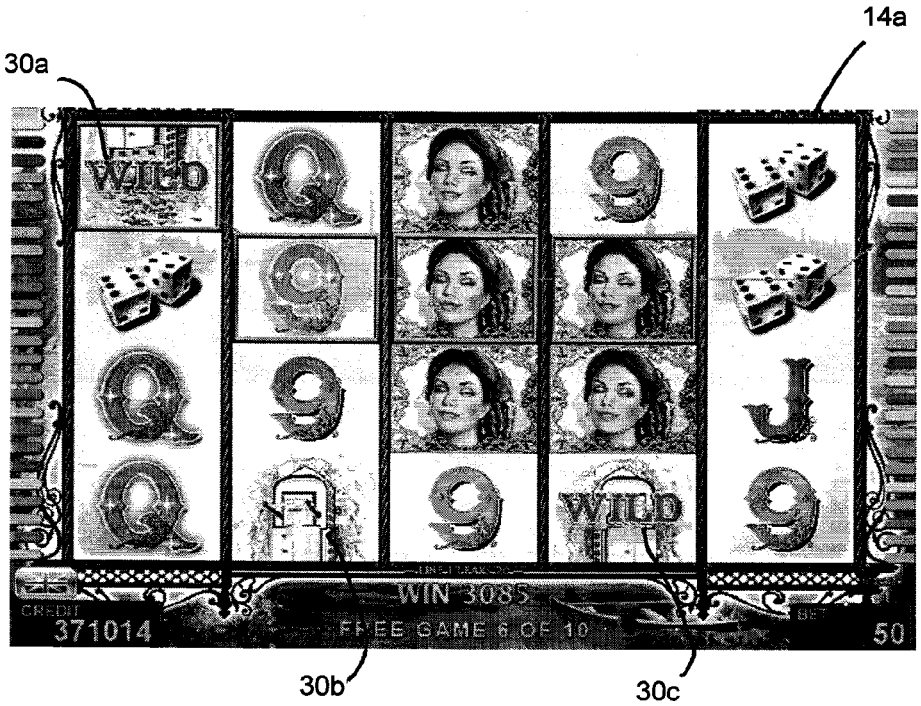
FIG. 7 is a screenshot of the lower display in accordance with the present invention depicting game play.

FIG. 7 shows further movement of the reel spin of the display 14*a*. The wild symbols 30*a*, 30*b* and 30*c* each shift locations on a respective reel upon completion of the reel spin. The wild symbols 30*a*, 30*b* and 30*c* also flash the word "wild" intermittently.

Each wild symbol 30*a*, 30*b* and 30*c* occupy only a single matrix position because the wild symbols 30*a*, 30*b* and 30*c* are located on edges of the matrix, i.e. in the first or last row.

According to one variant of game play, each spin in the bonus game reduces the activity of one of the Wild symbols. As shown the wild symbol 30*a* and the wild symbol 30*c* are active, displaying the word "wild", while the wild symbol 30*b* is inactive. The wild symbols 30*a*, 30*b* and 30*c* can be either active or inactive.

Figure 8:
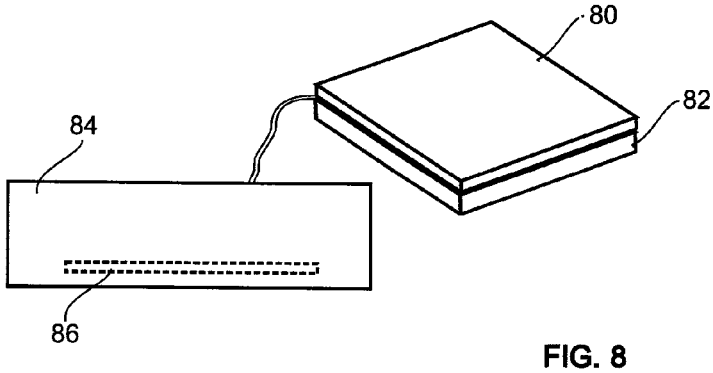
FIG. 8 is a perspective view of a computer and a display interface in accordance with the present invention.

FIG. 8 shows the computer 84, which mounts in the housing 12 of the gaming machine 10 and the computer 84, connects with a display 80. The display 80 includes a transmissive LCD panel and may include an integrated touch-screen 82. The computer includes a main board 86 having a controller, memory connected to the main board for storing software, software stored in the memory for operating the display 80, software drivers, and a main processor. In a preferred embodiment, the computer 84 includes two displays 80 to form an upper display and a lower display.

Figure 9:
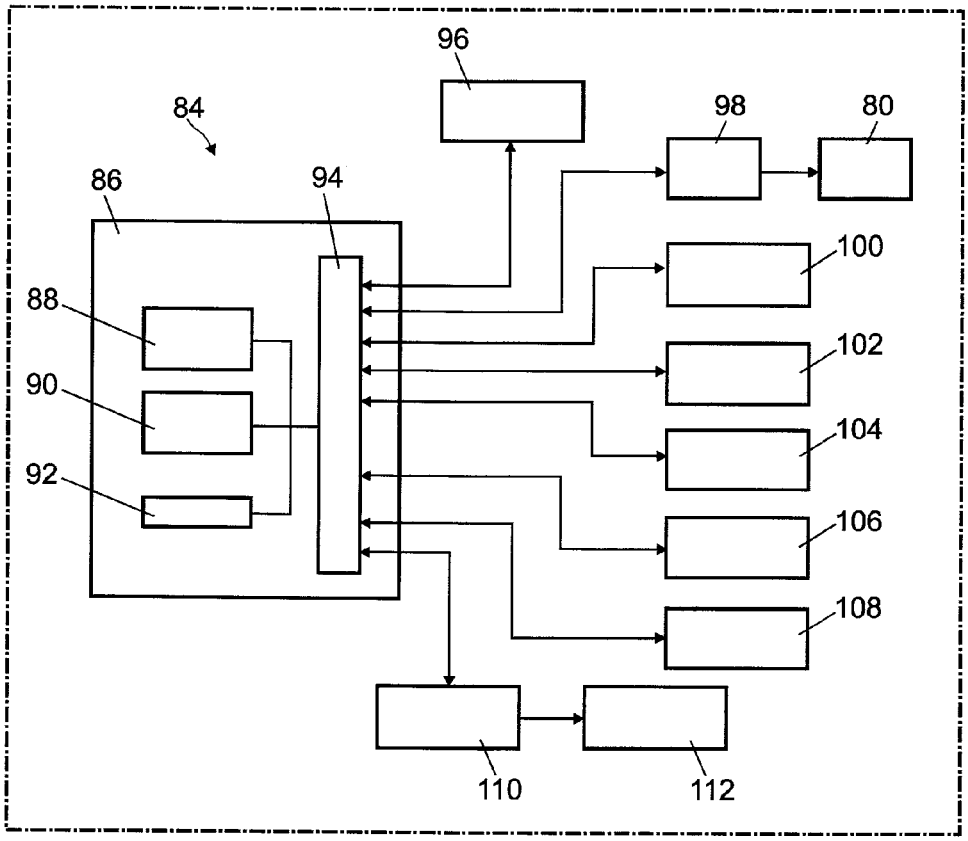
FIG. 9 is a system diagram in accordance with the present invention.

FIG. 9 shows a system diagram of the computer 84. The computer 84 includes a main board 86, program memory 88 being a computer readable medium, a main processor 90 and RAM 92 connected in operative communication. The computer 84 has an input output I/O controller 94. The I/O controller 94 communicates with a user interface control panel 96, display interface driver circuitry 98, a display unit 100, a coin acceptor 102, a bill acceptor 104, a card reader 106, a ticket reader/printer 108, and a sound circuit 110. The sound circuit 110 is in operative communication with speakers 112.

The coin acceptor 102 and the bill acceptor 104 accept currency and communicate the amount accepted to the I/O controller 94. The card reader 106 reads credit cards, debit cards, gift cards or other card having electronic indicia of monetary value.

The ticket reader 108 prints tickets and receipts revealing the winnings of a player, or other financial outcome. The ticket reader 108 also receives tickets having indicia of monetary value, such as a bar code, which is read by the ticket reader 108.

The sound circuit 110 is configured to provide an acoustic-based interface for the user. Each movement or action by a user may result in a particular sound, or instruction being generated by the computer 84. The speakers 112 communicate the sounds to the user.

While the present invention is disclosed in terms of various specific embodiments, it can be appreciated that these embodiments are by way of example only. There are several variations contemplated by the present invention, and with the popularity of electronic gaming interfaces, the term "reel" should be broadly understood to include any set of moveable images, defining a matrix column, that are used to establish a payout. Accordingly, the scope of the invention is defined by the appended claims.

What is claimed is:

1. A gaming machine having standard and bonus game play mode, comprising:

a housing;

an interface attached to a housing;

a computer in operative communication with the interface, the computer having a memory and a processor, the memory stores game play instructions and a set of symbols including game symbols, scatter symbols and wild symbols;

the game play instructions include instructions for a standard game play mode and bonus game play mode;

during standard game play mode, the interface displays a matrix of symbols representing reels, and the computer calculates payouts based on the symbols, which are randomly arranged within the matrix;

when a predetermined number of scatter symbols appear in the matrix of symbols in standard game play mode, bonus game play commences and at least some of the scatter symbols are transformed into wild symbols that remain during bonus game play;

bonus game play mode includes multiple reel spins, the wild symbols presented at commencement of bonus game play mode remain stationary during each reel spin and then as the reels are slowed, the wild symbols move to a random location in the matrix of symbols, and during bonus game play mode, the maximum number of wild symbols displayed in any matrix column is one and the wild symbol covers two locations in any matrix column where the wild symbol appears.

2. A gaming machine as set forth in claim 1, wherein the random location in the matrix of symbols excludes matrix locations previously occupied by a wild symbol during a previous reel spin during bonus game play.

3. A gaming machine as set forth in claim 2, wherein the bonus game play mode lasts for ten reel spins.

4. A gaming machine as set forth in claim 2, wherein bonus game play commences when four scatter symbols appear.

5. A gaming machine as set forth in claim 2, wherein bonus game play commences when five scatter symbols appear.

6. A gaming machine as set forth in claim 2, wherein the matrix of symbols is a four by five matrix having twenty symbols.

7. A gaming machine as set forth in claim 2, wherein during bonus game play, the computer determines mode paylines and payouts after each reel spin, upon completion of bonus game play mode, the computer credits the sum of any payouts to the standard game play.

* * * * *